US007975595B2

(12) United States Patent
Robinson et al.

(10) Patent No.: US 7,975,595 B2
(45) Date of Patent: Jul. 12, 2011

(54) FIREARM

(75) Inventors: Alexander J. Robinson, Salt Lake City, UT (US); Darin G. Nebeker, Kaysville, UT (US); Jon C. Holway, Eagle Mountain, UT (US)

(73) Assignee: RMDI, LLC, North Salt Lake, UT (US)

( * ) Notice: Subject to any disclaimer, the term of this patent is extended or adjusted under 35 U.S.C. 154(b) by 481 days.

(21) Appl. No.: 12/246,315

(22) Filed: Oct. 6, 2008

(65) Prior Publication Data

US 2009/0031607 A1 Feb. 5, 2009

Related U.S. Application Data

(60) Division of application No. 11/055,580, filed on Feb. 10, 2005, and a continuation-in-part of application No. 10/911,963, filed on Aug. 4, 2004, now Pat. No. 7,596,900.

(60) Provisional application No. 60/544,586, filed on Feb. 13, 2004.

(51) Int. Cl.
*F41A 3/26* (2006.01)

(52) U.S. Cl. ..... 89/185; 89/191.01; 89/192; 42/14; 42/16; 42/47

(58) Field of Classification Search ..... 89/185, 89/191.01, 192, 179, 180, 184, 187.01, 188; 42/14, 16, 47
See application file for complete search history.

(56) References Cited

U.S. PATENT DOCUMENTS

| | | | | |
|---|---|---|---|---|
| 2,422,532 | A | 6/1947 | Dehm | |
| 3,593,452 | A | 7/1971 | Pekarek | |
| 3,618,457 | A | 11/1971 | Miller | |
| 3,630,118 | A * | 12/1971 | Stoner | 89/13.05 |
| 3,648,562 | A * | 3/1972 | Loeble | 89/185 |
| 3,675,534 | A | 7/1972 | Beretta | |
| 3,688,640 | A | 9/1972 | Seecamp | |
| 3,710,495 | A | 1/1973 | Ziegler et al. | |
| 3,771,415 | A | 11/1973 | Into et al. | |
| 3,776,095 | A | 12/1973 | Atchisson | |
| 3,846,928 | A | 11/1974 | Ruger et al. | |
| 3,847,054 | A | 11/1974 | Ruger et al. | |
| 3,850,076 | A | 11/1974 | Atchisson | |
| 3,857,323 | A | 12/1974 | Ruger et al. | |

(Continued)

FOREIGN PATENT DOCUMENTS

DE 1890933 4/1964

(Continued)

OTHER PUBLICATIONS

Operating and Safety Instruction Manual for the Bushmaster XM15, Bushmaster Firearms, Inc., 1999.

(Continued)

*Primary Examiner* — Michelle Clement

(57) ABSTRACT

A firearm having a bolt carrier comprising an operating rod slot that is open at an end of the bolt carrier. The bolt carrier also includes a cam slot extending from the operating rod slot. The firearm includes a bolt having a protrusion extending from the bolt which enters and is movable within the cam slot. The firearm further includes an operating rod comprising a piston and a foot. The foot is disposed within the operating rod slot to prevent the separation of the bolt from the bolt carrier and to connect the operating rod to the bolt carrier.

17 Claims, 7 Drawing Sheets

U.S. PATENT DOCUMENTS 3,999,461 A 12/1976 Johnson et al.
4,022,105 A * 5/1977 White ..... 89/149
4,023,465 A 5/1977 Inskip
4,028,993 A 6/1977 Reynolds
4,044,487 A * 8/1977 Hutton et al. ..... 42/16
4,056,038 A 11/1977 Rath
4,057,003 A 11/1977 Atchisson
4,058,922 A 11/1977 Elbe et al.
4,066,000 A 1/1978 Rostocil
4,116,193 A 9/1978 Chiba
4,128,042 A 12/1978 Atchisson
4,213,261 A * 7/1980 Claypool ..... 42/16
4,227,439 A 10/1980 Gillum
4,231,177 A 11/1980 Foote
4,244,273 A 1/1981 Langendorf, Jr. et al.
4,326,353 A 4/1982 Ludwig et al.
4,358,986 A 11/1982 Giorgio
4,389,919 A 6/1983 Kast et al.
4,398,448 A * 8/1983 LaFever ..... 89/185
4,429,479 A 2/1984 Johnson
4,433,610 A 2/1984 Tatro
4,438,678 A 3/1984 Ruger
4,469,006 A 9/1984 Teppa
4,471,551 A 9/1984 Mattarelli
4,475,438 A 10/1984 Sullivan
4,502,367 A 3/1985 Sullivan
4,505,182 A 3/1985 Sullivan
4,521,985 A 6/1985 Smith et al.
4,523,509 A 6/1985 Thevis et al.
4,562,659 A 1/1986 Neta
4,579,034 A 4/1986 Holloway
4,599,818 A 7/1986 Fedora et al.
4,651,445 A 3/1987 Hannibal
4,693,170 A 9/1987 Atchisson
4,713,902 A 12/1987 Wigton
4,756,228 A 7/1988 Rath
4,759,144 A 7/1988 Egan et al.
4,765,224 A 8/1988 Morris
4,791,851 A 12/1988 Stoner
4,835,892 A 6/1989 Ruger et al.
4,867,040 A 9/1989 Barrett
4,872,391 A 10/1989 Stoner
4,893,547 A 1/1990 Atchisson
4,920,678 A 5/1990 Brown
4,920,855 A 5/1990 Waters
4,932,148 A 6/1990 Barrett
4,942,802 A 7/1990 Stoner
4,972,617 A * 11/1990 Major ..... 42/25
5,038,666 A * 8/1991 Major ..... 89/197
5,046,275 A 9/1991 Brown
5,103,714 A 4/1992 LaFrance
5,123,329 A 6/1992 Irwin
5,155,284 A 10/1992 Flashkes
5,452,534 A 9/1995 Lambie
5,519,954 A 5/1996 Garrett
5,540,008 A 7/1996 Kirnstatter
5,551,179 A 9/1996 Young
5,581,926 A 12/1996 Taalib-din et al.
5,588,241 A 12/1996 Hurley
5,634,288 A 6/1997 Martel
5,663,522 A 9/1997 Kuehl
5,664,355 A 9/1997 Ronkainen
5,680,724 A 10/1997 Peterken
5,770,814 A * 6/1998 Ealovega ..... 89/131
5,900,577 A 5/1999 Robinson et al.
6,012,246 A 1/2000 Robinson et al.
6,019,024 A 2/2000 Robinson et al.
6,070,352 A 6/2000 Daigle
6,101,918 A 8/2000 Akins
6,418,655 B1 7/2002 Kay
6,484,430 B1 11/2002 Robinson et al.
6,510,778 B1 1/2003 Irwin
6,606,812 B1 8/2003 Gwinn, Jr.
6,634,274 B1 10/2003 Herring
6,681,677 B2 1/2004 Herring
6,722,255 B2 4/2004 Herring
6,848,351 B1 2/2005 Davies
6,907,814 B2 6/2005 Spinner et al.
6,910,404 B2 6/2005 Wolff et al.
6,931,978 B1 8/2005 Dionne
7,040,213 B2 * 5/2006 Herring ..... 89/33.14
7,213,498 B1 * 5/2007 Davies ..... 89/198
7,219,461 B1 5/2007 Keeney et al.
7,219,462 B2 5/2007 Finn
7,302,881 B1 12/2007 Tertin
7,827,722 B1 * 11/2010 Davies ..... 42/75.02
2002/0139241 A1 10/2002 Butler
2002/0162266 A1 11/2002 Clay
2003/0066226 A1 4/2003 Martin
2003/0089014 A1 5/2003 Schuerman
2003/0136041 A1 * 7/2003 Herring ..... 42/18
2004/0020092 A1 2/2004 Christensen
2005/0011345 A1 1/2005 Herring
2005/0081707 A1 * 4/2005 Herring ..... 89/33.14
2005/0188590 A1 9/2005 Baber et al.
2005/0188591 A1 9/2005 Stone
2005/0223613 A1 10/2005 Bender
2005/0229463 A1 10/2005 Tashjian
2006/0236582 A1 10/2006 Lewis et al.
2007/0033851 A1 2/2007 Hochstrate et al.
2008/0276797 A1 * 11/2008 Leitner-Wise ..... 89/191.01
2010/0000400 A1 * 1/2010 Brown ..... 89/191.01

FOREIGN PATENT DOCUMENTS

WO WO 2005/047804 A2 5/2005

OTHER PUBLICATIONS

Operators Manual HK USP Compact Pistol, Heckler & Koch, Inc., 2000.
Argo, Benelli, Jan. 2002.
Operators Manual, HK SL8-1 Rifle, May 2003.
Bolt Release Web Site located at www.gswagner.com/forsale/boltrelease/boltrelease.htm, accessed on Jun. 2, 2003.
Bolt Release Web Site located at www.gswagner.com/forsale/boltrelease/boltreleaseinstructions.html, accessed on Jun. 8, 2003.
Heckler & Koch GmbH's MP7 Firearm, believed to be 2002, 1 page.
Heckler & Koch, XM8—US M4 System Comparison, believed to be Jan. 2004, 4 pages.
Spare Parts Catalogue, G36 E—G36K E Rifle, MG36 E Machine Gun, believed to be approximately 1998, 34 pages.
Manual, The FAL Rifle Classic Edition, R. Blake Stevens et al., Collector Grade Publications Inc., 1993, pp. 39-41, 49, 57, 61, 164, Figures 1a. The T48 Rifle, Figure 1b. The T48E1 Rifle, Figure 154, Figure 155.
The Black Rifle, m16 Retrospective, R. Blake Stevens et al., Collector Grade Publications Inc., 1992, pp. 185-188.
Office Action for U.S. Appl. No. 10/911,963, filed Aug. 4, 2004, mailed from USPTO on Mar. 26, 2008, 22 pgs.
Office Action for U.S. Appl. No. 10/055,580, filed Feb. 10, 2005, mailed from USPTO on Sep. 29, 2008, 18 pgs.
Raw, Steve, "The Last Enfield, SA80—The Reluctant Rifle." Published by Collector's Grade Publication, Copyright 2003, 1 pg.
M-16 Upper Receiver SOCOM Variant, published before Sep. 13, 2001, 1 pg.
Webpage, www.dpmsinc.com, advertising an Extractor Spring Asy/w Rub Tip, May 26, 2005, 1 pg.
Webpage, www.ketmer.com, advertising the D-fender, May 26, 2005, 1 pg.

* cited by examiner

FIREARM

RELATED APPLICATIONS

This utility application is a divisional of and claims priority to U.S. patent application Ser. No. 11/055,580 filed Feb. 10, 2005, entitled FIREARM, which claims the benefit of U.S. Provisional Application No. 60/544,586, filed Feb. 13, 2004, entitled IMPROVED FIREARM, and also claims the benefit of U.S. patent application Ser. No. 10/911,963, filed Aug. 4, 2004, entitled MULTI-CALIBER AMBIDEXTROUSLY CONTROLLABLE FIREARM, all of which are hereby incorporated herein by reference.

BACKGROUND OF THE INVENTION

The present invention relates to firearms. More specifically, the present invention relates to firearms that can be quickly configured with a minimum of additional parts to fire different calibers of ammunition with improved reliability in harsh environmental and firing conditions.

Currently available firearms have many limitations that can potentially place a user at risk, require long manufacturing times, or be expensive to produce. For example, receivers for firearms that include guidance features, such as internal rails, within a passageway tend to require significant effort to assemble. Often the rails are first manufactured and then attached to the receiver through welding or mechanical fasteners. Alternatively, the receiver is made in halves with integrally formed rails and then the halves are then welded together.

Currently available firearms also present serious safety issues where water is able to fill a barrel or a squib round is fired and the bullet fails to exit the barrel. In these situations, the pressures within the chamber may lead to mechanical failure of the firearm. Often the location of mechanical failure of the firearm is at or near the location of the extractor. A mechanical failure at or near the location of the extractor can render a firearm useless. In a combat situation, a useless firearm places the user at great risk.

Additionally, many currently available firearms that are used in combat and include a rotating bolt eject a spent cartridge upward into the air which may signal the location of the user of the firearm. Thus, the spent cartridge may give away the position of the user to an enemy during combat.

Some currently available firearms are able to fire different calibers of cartridges. However, these firearms all use the same size ejection port for each caliber, which may lead to problems with ejection. For example, the ejection port may be too large so that the spent cartridge is ejected in a random pattern. This random ejection pattern may lead to lost brass as well as user frustration as the brass may be ejected rearward into the user of the firearm. Where the ejection port is functional but slightly too small, the spent cartridge may fail to entirely eject from the firearm which may raise reliability issues.

Similarly, firearms that are able to fire different calibers of cartridges use the same ejector in the same location for all calibers, which can also lead to ejection problems with certain calibers or entirely prevent a firearm designed to fire one caliber from firing larger or smaller cartridges. For example, the ejector for a firearm designed to fire a 5.56 NATO cartridge may be unable to fire a Springfield 30.06 cartridge because the ejector is disposed too close to the barrel.

Currently available firearms for use with multiple calibers may also be difficult to take apart for cleaning or modification. Currently available firearms may also require relatively long periods of time to change from one caliber to another.

Accordingly, a need exists for a firearm that is reliable and durable under harsh conditions and is yet inexpensive to manufacture and requires a minimum of assembly. Furthermore, a need exists for a firearm that is able to reliably extract each round despite fouling and dirt in the receiver. Additionally, a need exists for a firearm that may be used reliably with a variety of differently sized cartridges. A need exists for a firearm that can withstand the pressures within the chamber that result from water or a bullet within the barrel without mechanical failure. A need also exists for a firearm that can eject a spent cartridge in a reliable manner laterally away from the user and not vertically in the air to give the user's position away. Accordingly, a need exists for a firearm that may be quickly changed from firing one caliber to another.

BRIEF SUMMARY OF THE INVENTION

The present invention has been developed in response to the present state of the art, and in particular, in response to the problems and needs in the art that have not yet been fully solved by currently available firearms. The firearm of the invention may be used to fire a cartridge that includes a base. The firearm generally includes a barrel having a chamber, a receiver, a bolt supported by the receiver; and a fire control group. The firearm may also include a firing pin. The fire control group may include a hammer, trigger, a bolt hold open device, a disconnect, an auto sear, and a fire selector/safety switch device. The firearm may also include a firing pin that is guided by the bolt.

In some embodiments, the receiver may be a two piece receiver that includes a lower receiver containing the fire control group and an integrally formed upper receiver that may include a longitudinal axis, a passageway extending generally parallel to the longitudinal axis, and a guidance feature extending into the passageway and along the passageway generally parallel to the longitudinal axis. The guidance feature may be an internal rail that guides the movement of the bolt within the upper receiver.

In some configurations, the upper receiver and its guidance feature and passageway are formed by extrusion. Additionally, the upper receiver may include a second passage way that is formed as the upper receiver is extruded. Extrusion permits the formation of multiple features in one processing step, which can minimize machining and assembly time and reduce manufacturing costs. For example, the upper receiver may be extruded with an accessory rail that extends parallel to the longitudinal axis. In some configurations, the accessory rail may be extruded at the 3, 6, 9, & 12 o'clock positions.

The upper receiver extrusion may be cut to size and then machined to provide additional features. For example, the integrally formed upper receiver may include a charging handle slot that is machined into the upper receiver and the extruded accessory rail may be machined to provide additional detail and utility to the accessory rail.

The barrel may be attached to the receiver or where a two piece receiver is used, the barrel may be attached to the upper receiver. The barrel may include a barrel extension with locking features for locking the bolt against the chamber. The barrel extension may also include a beveled barrel retention recess.

For attaching the barrel to the receiver, a barrel attachment device may be used. The barrel attachment device may have a threaded section and a tapered end. Additionally, the angle of the tapered end may be the reciprocal of the angle of the beveled barrel retention recess. The upper receiver may include a barrel retention feature that allows the barrel attachment device to be disposed in the barrel retention feature. The barrel retention feature may be threaded to allow the threaded section of the barrel attachment device to engage the barrel retention feature so that the tapered end engages the beveled barrel retention recess to attach the barrel to the upper receiver.

In some embodiments, the bolt may be connected to a bolt carrier. The bolt carrier may be supported by the upper receiver and may be guided by the guidance feature of the upper receiver. The bolt carrier may include an operating rod slot that is open at an end of the bolt carrier and a cam slot that extends from the operating rod slot. The bolt may include a protrusion that extends from the bolt and into the cam slot so that the protrusion is movable within the cam slot.

The bolt carrier may also include a safety extension disposed below the bolt. The safety extension of the bolt carrier prevents the hammer from striking the firing pin until the bolt is fully locked against the chamber. The safety extension may also include an auto trip. The auto trip engages the auto sear to allow for fully automatic fire of the firearm.

The bolt carrier may also include a forward assist feature that may be selectively engaged by a forward assist device of a non-reciprocating charging handle. The forward assist device of the charging handle is used to selectively engage the forward assist feature of the bolt carrier to provide manual locking of the bolt against the chamber.

The bolt may further include a bolt face and at least two lugs for locking the bolt face against the chamber of the barrel. In some configurations, the lugs of the bolt may be disposed within the barrel extension and abut the locking features of the barrel extension in order to close an end of the chamber with the bolt face allowing the firearm to be safely fired.

The bolt may also include an ejector access groove, a sliding extractor, and a polymer spring that biases the sliding extractor against the base of the cartridge to retain the base of the cartridge against the bolt face. The ejector access groove permits the bolt to move past an ejector so that the ejector may dislodge a cartridge from the bolt face. A polymer spring provides the advantage over metal springs that a polymer spring may be much smaller, and yet provide the same force as a larger metal spring. Therefore, a polymer spring permits smaller assemblies to be used that are not otherwise possible.

For convenience in describing some features of the bolt, the bolt includes a plane that extends through the middle of the bolt face and perpendicular to the bolt face. The sliding extractor may be disposed at an angle ranging from about thirty degrees to about fifteen degrees from the plane extending through the middle of the bolt face. Alternatively, the sliding extractor may be disposed at an angle ranging from about twenty-five degrees to about twenty degrees from the plane extending through the middle of the bolt face. This positioning of the sliding extractor and the ejector allows a spent cartridge to be ejected almost horizontally from the firearm, which minimizes the ability of an enemy to see the ejecting spent cartridges and pinpoint the location of the user of the firearm.

Where the barrel includes a barrel extension that includes a support surface, the extractor further includes an extractor head. As the bolt is locked within the barrel extension, the extractor head engages the support surface to support the extractor against the base of a cartridge. Having the support surface directly support the extractor helps to prevent mechanical failure of the extractor where abnormally high pressure occurs in the chamber during the firing of a cartridge.

The bolt may be rotated in a direction along the shortest distance from the feed lug to the extractor about the bolt face to lock the bolt face against the chamber or in other words, to close the chamber and allow the firearm to be safely discharge the cartridge. In some configurations of the invention, the bolt may also be rotated counter-clockwise to lock against the chamber as viewed from the bolt to the barrel.

The direction of bolt rotation can affect the angle of ejection of spent cartridges from the firearm, as well as the size and placement of lugs, extractor, and other features of the bolt. For example, in one embodiment of the invention, the counter-clockwise rotation of the bolt allows the use of three large lugs and a large extractor disposed at approximately 20 degrees from the plane about the bolt face.

The protrusion may be connected to the bolt carrier by an operating rod. Specifically, the operating rod may include a piston and a foot. The foot of the operating rod is disposable within the operating rod slot of the bolt carrier to prevent the bolt from separating from the bolt carrier and to connect the operating rod to the bolt carrier. More specifically, the foot of the operating rod is seated within the operating rod slot of the bolt carrier, which prevents the protrusion of the bolt from sliding out of the cam slot of the bolt carrier. Thus, the bolt is slidably connected to the bolt carrier.

The operating rod may further include an anti-bounce mechanism. As the bolt in some firearms is closed against the chamber, the force is great enough that the bolt carrier bounces so that the firearm may not function reliably. The anti-bounce mechanism counteracts this tendency to bounce.

Disposing the anti-bounce mechanism in the operating rod allows a smaller bolt carrier and bolt to be used in the firearm, which can result in a lighter and smaller firearm. In some embodiments of the invention, the anti-bounce mechanism of the operating rod includes a cavity disposed within the operating rod and one or more weights movable within the cavity. Specifically, once the bolt closes on the chamber, the weight moves within the cavity to be stopped at a end of the cavity. The transfer of energy from the weight to the operating rod and consequently to the bolt and the bolt carrier counteracts the bounce to keep the bolt carrier properly positioned against the chamber.

Where a two part receiver is used, the fire control group may be connected to the lower receiver of the firearm. The lower receiver may also include an attachment structure. The attachment structure is used to attach the lower receiver to the upper receiver.

The firearm may also include a recoil spring assembly disposed proximate the operating rod. In some configurations, the recoil spring assembly may be alternatively connected to the operating rod, the bolt carrier, the bolt, or the piston. The recoil spring assembly may include a mating attachment structure and a disassembly button. The mating attachment structure is attached to the attachment structure of the lower receiver to attach the lower receiver to the upper receiver. The disassembly button may be actuated to detach the mating attachment structure from the attachment structure in order to detach the lower receiver from the upper receiver. The disassembly button may be disposed on a lateral side of the upper receiver so that the upper receiver may include an accessory rail that extends the complete length of the upper receiver.

In some configurations, the ejector of the firearm may be attachable to the receiver at a plurality of locations. Having an ejector that is removably attachable to the receiver at a plurality of locations permits the firearm to accommodate different cartridge sizes. Specifically, adjusting the position of the ejector affects how a spent cartridge is ejected from the firearm.

The firearm in some configurations may also include an ejection buffer attachable to the receiver at a plurality of locations. The ejection buffer may be used to adjust the size of the ejection port of the firearm which also helps to permit the firearm to accommodate different cartridge sizes. For example, if the ejection port is too large, the spent cartridge may eject rearward toward the user of the firearm. If the ejection port is too small, the spent cartridge will fail to discharge, causing the firearm to fail.

The invention also includes a method for manufacturing an integrally formed upper receiver. The method includes the steps of extruding an upper receiver having a passageway and a guidance feature disposed in the passageway, and machining the upper receiver to form a barrel attachment feature. Alternatively, the guidance feature may be a slot that extends out of the passageway, such as a slot or groove. During the step of extruding the upper receiver, the upper receiver may also be extruded to include an accessory rail and a second passageway that is a gas tube hole.

The method may also include the steps of machining the accessory rail to provide grooves that extend perpendicular to the length of the accessory rail and machining a charging handle slot and a charging handle access groove into the upper receiver. Additionally, the method may include the step of machining the passageway and the second passage way to form a bolt carrier cavity.

Additionally, the invention includes a method for changing the caliber of a firearm with caliber conversion parts. The firearm includes at least a receiver, a barrel attached to the receiver, and an ejection buffer that is attachable to the upper receiver at a plurality of locations. The caliber conversion parts include at least a second barrel. The method includes the steps of removing the barrel from the upper receiver, attaching the second barrel to the upper receiver, detaching the ejection buffer from the upper receiver at a first location, and attaching the ejection buffer to the upper receiver at a second location.

Where the firearm further includes a bolt connected to a bolt carrier, an operating rod connected to the bolt carrier, wherein the bolt, bolt carrier, and operating rod are disposed within the firearm and the caliber conversion parts include a second bolt, the method may also include the steps of removing the bolt, bolt carrier, and operating rod from the firearm, disconnecting the operating rod from the bolt carrier to allow removal of the bolt from the bolt carrier, removing the bolt from the bolt carrier, disposing the second bolt in the bolt carrier, connecting the operating rod to the bolt carrier to prevent removal of the second bolt from the bolt carrier, and disposing the second bolt, bolt carrier, and operating rod in the firearm.

In addition to the components described above, the firearm may include furniture such as a hand guard, a butt stock, and a pistol grip. The hand guard may be attached to the firearm proximate the barrel. The butt stock and pistol grip may be attached to the receiver or in some configurations, the lower receiver. The firearm may also include a feed attachment device such as a magazine well or belt feed mechanism.

These and other features of the present invention will become more fully apparent from the following description, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the improved firearm of the present invention, as represented in FIGS. 1 through 14, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects.

The term "abutting" refers to items that are in direct physical contact with each other, although the items may not be attached together. The terms "integrally formed" refer to a body that is manufactured integrally, i.e., as a single piece, without requiring the assembly of multiple pieces. Multiple parts may be integrally formed with each other if they are formed from a single work piece. Thus, parts that are welded or otherwise fastened together are not integrally formed.

Figure 1:
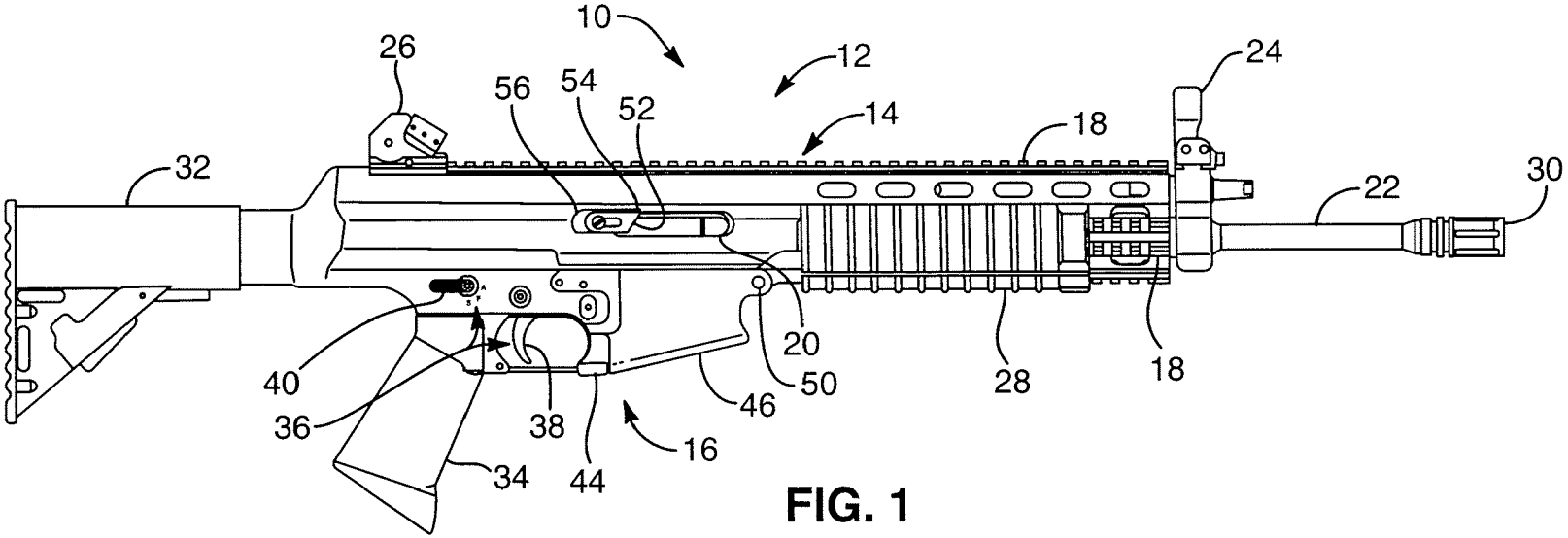
FIG. 1 is a side elevation view of a firearm according to the invention.

Referring to FIG. 1, a side elevation view illustrates a firearm 10 according to the invention. As shown, the firearm 10 includes a receiver 12 that includes an upper receiver 14 and a lower receiver 16. The upper receiver 14 may be integrally formed with accessory rails 18 and an ejection port 20 for allowing spent cartridges (not shown) from the firearm 10.

The firearm 10 also includes a barrel 22 that is attached to the upper receiver 14. Optionally, the firearm 10 may also include a front sight 24, a rear sight 26, hand guards 28, and a flash hider 30. In some configurations, the firearm 10 may include vertical grips, a grenade launcher, a bayonet lug, a muzzle brake, a scope, a red dot sight, a rangefinder, a silencer, a light system, a laser, or other accessories known in the art. The hand guards 28 are shown attached to the integral accessory rail system 18 and may be removed as desired by a user.

The lower receiver 16 may be attached to a butt stock 32 and a pistol grip 34. A fire control group 36 including a trigger 38, a selector/safety switch 40, and a bolt hold open device 44 are coupled to the lower receiver 16 in this configuration. In some configurations, the fire control group may be coupled to the receiver 12 or the upper receiver 14. The lower receiver 16 may be integrally formed with a magazine well 46 for receiving a magazine (not shown). Alternatively, the magazine well, cartridge feeding device, or a belt feed device (not shown) may be separately formed and connected to the firearm.

The upper receiver 14 and the lower receiver 16 are pivotally coupled by a receiver pin 50. The receiver pin 50 allows the upper receiver 14 to be pivoted away from the lower receiver 16 providing access to internal components for cleaning and maintenance.

The firearm 10 also includes an ejection buffer 52 attachable to the upper receiver 14 at a plurality of locations. The ejection buffer 52 is used to adjust the size of the ejection port as well as to better control the direction of ejection of spent cartridges. More specifically, the ejection buffer may be attached at a first location 54 or at a second location 56 or at any location in between the first location 54 and the second location 56, depending on the caliber of cartridge that a user desires to fire from the firearm 10. For example, the first location 54 may be used for calibers with smaller cartridges and the second location 56 may be used for larger cartridges.

Figure 2:
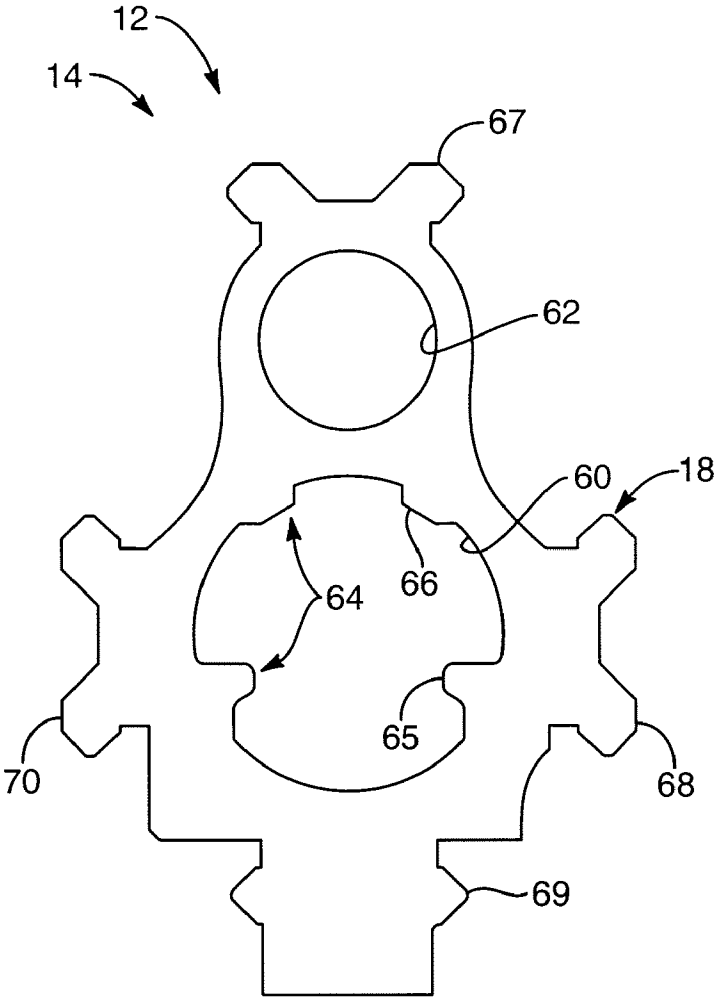
FIG. 2 is a rear elevation view of the upper receiver of the firearm as extruded.
Figure 10:
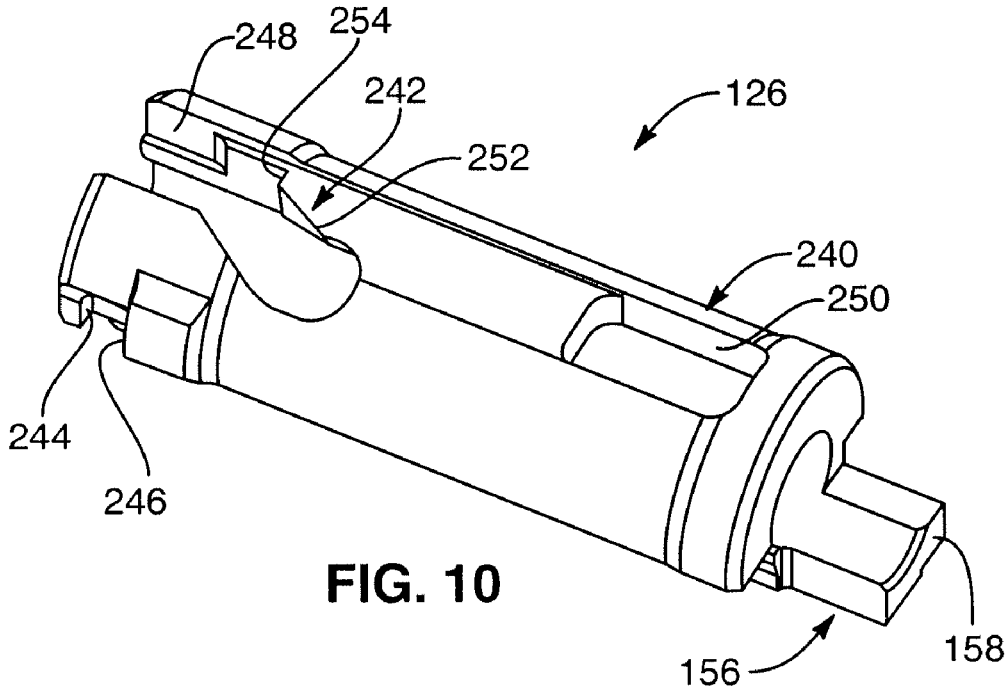
FIG. 10 is a perspective view of a bolt carrier according to the invention.

Referring to FIG. 2, a rear elevation view illustrates the upper receiver 14 of the firearm 10 of FIG. 10. The upper receiver 14 may be initially formed by extrusion and may be made of aluminum or steel. Alternatively, the upper receiver 14 may be made of any plastic, composite, ceramic, or metal that is relatively tough and wear resistant. Extruding the upper receiver 14 permits several features of the upper receiver 14 to be formed at the time of extrusion, which lowers manufacturing costs and production time. Additionally, extruding the upper receiver 14 provides the upper receiver 14 with a natural longitudinal is so that the features formed during extrusion extend generally parallel to the longitudinal axis.

As shown, the upper receiver 14 is extruded to include the accessory rails 18, a first passageway 60, a second passageway 62, and guidance features 64. The guidance features 64 extend into the passageway and along the passageway to help guide a bolt (shown in FIG. 6) or a bolt carrier (shown in FIG. 6) through the first passageway 60 of the receiver 12. The guidance features 64 as shown include internal rails 65 and shoulders 66 that are used to guide the movement of internal components of the firearm 10. The accessory rails 18 include a rail at the 12 o'clock position 67, the 3 o'clock position 68, the 6 o'clock position 69, and the 9 o'clock position 70.

An advantage of extruding the features of the upper receiver 14 is that the features formed by extrusion are generally straight and parallel to each other. Otherwise assembly may result in a great deal of variation.

Figure 3:
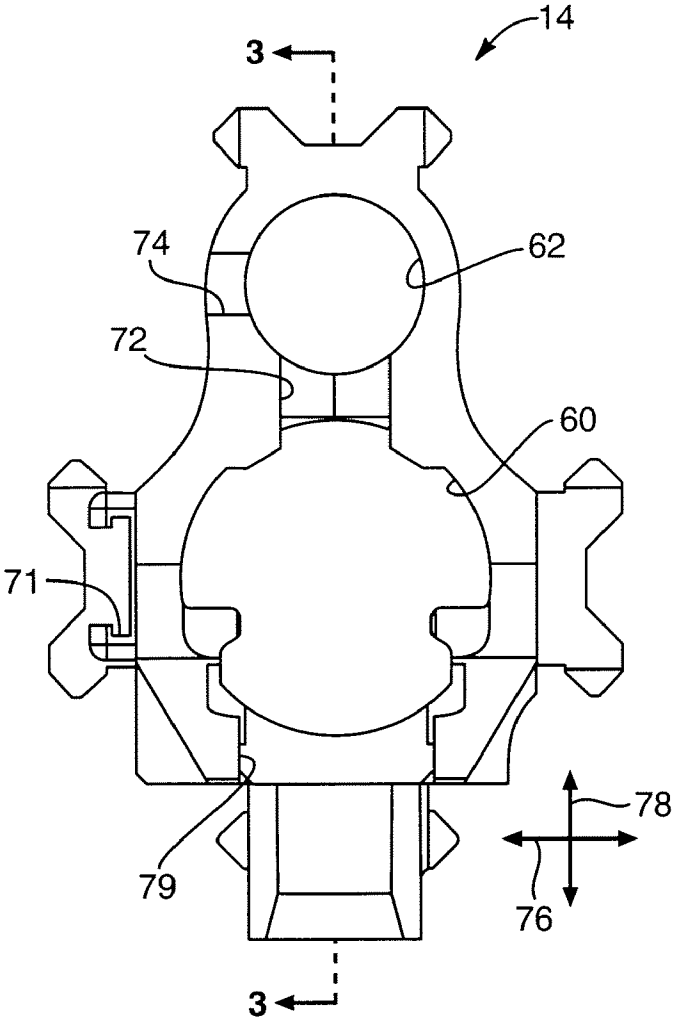
FIG. 3 is a rear elevation view of the finished upper receiver of FIG. 2.

Referring to FIG. 3, a rear elevation view shows the finished upper receiver 14 of FIG. 2. Once the upper receiver 14 is extruded, various machining methods known in the art, such as drilling, tapping, milling, etc., are used to form other integral features of the upper receiver 14. As shown, the upper receiver 14 when finished may include a charging handle slot 71, a operating rod cavity 72, a disassembly button attachment point 74, and other features known in the art that enhance the functional and aesthetic qualities of the upper receiver 14.

The upper receiver 14 also has a lateral direction 76 and a vertical direction 78. The disassembly button attachment point 74 disposes a disassembly button (shown in FIG. 13) on a lateral 76 side of the upper receiver 14. The disassembly button (shown in FIG. 13) permits the upper receiver 14 to be selectively detached and attached to the lower receiver 16 shown in FIG. 1. By disposing the disassembly button attachment point 74 on the lateral 76 side of the upper receiver 14 a user may grip the upper receiver and slide the disassembly button (shown in FIG. 13) to detach the upper receiver 14 from the lower receiver 16 of FIG. 1.

Additionally, the upper receiver 14 includes a bottom cut 79 that allows the fire control group 36 and other components of the lower receiver 16 to interact with the components connected to the upper receiver 14.

Figure 4:
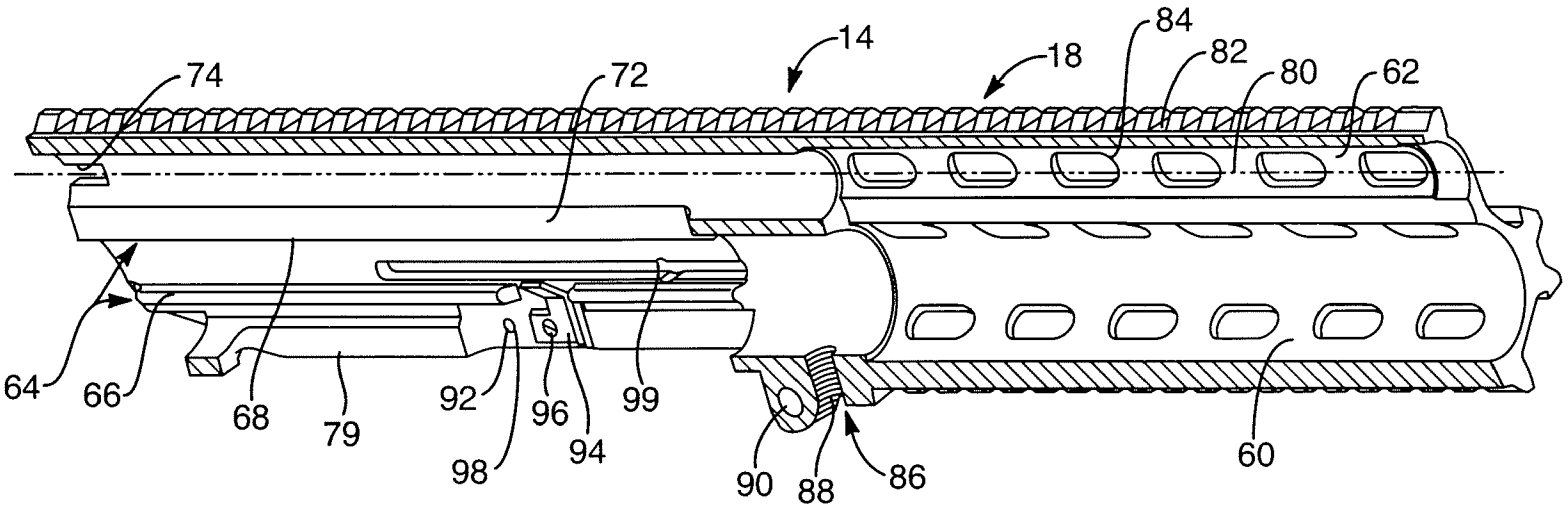
FIG. 4 is a perspective view of a cross section taken along Section 3-3 of the extruded upper receiver of FIG. 3.

Referring to FIG. 4, a perspective view of a cross section taken along Section 3-3 illustrates the finished upper receiver 14 of FIG. 3. As shown, the first passageway 60, the second passageway 62, the guidance features 64 extend generally parallel to a longitudinal axis 80. The operating rod cavity 72 also extends generally parallel to the longitudinal axis 80 and midway into the upper receiver 14. The accessory rail 18 has been machined to provide grooves 82 that extend perpendicular to the longitudinal axis 80 so that the accessory rail 18 as shown is a 1913 type accessory rail.

Lightening cuts 84 have also been made in the upper receiver 14 in order to reduce the weight of the upper receiver 14. The upper receiver 14 also includes a barrel attachment feature 86 that may be a threaded hole 88. A pivot hole 90 has also been machined that allows the upper receiver 14 to pivot around the receiver pin 50 (shown in FIG. 1).

A plurality of holes 92 have also been cut to provide for the attachment of an ejector 94 to the upper receiver at a plurality of locations. More specifically, the ejector may be attached at a first location 96 or a second location 98. The first location 96 may be used for calibers with smaller cartridges and the second location 98 may be used for larger cartridges.

The upper receiver 14 also includes a charging handle access groove 99 that permits a charging handle (shown in FIG. 14) disposed in the charging handle slot 71 to access the interior of the upper receiver 14.

Figure 5:
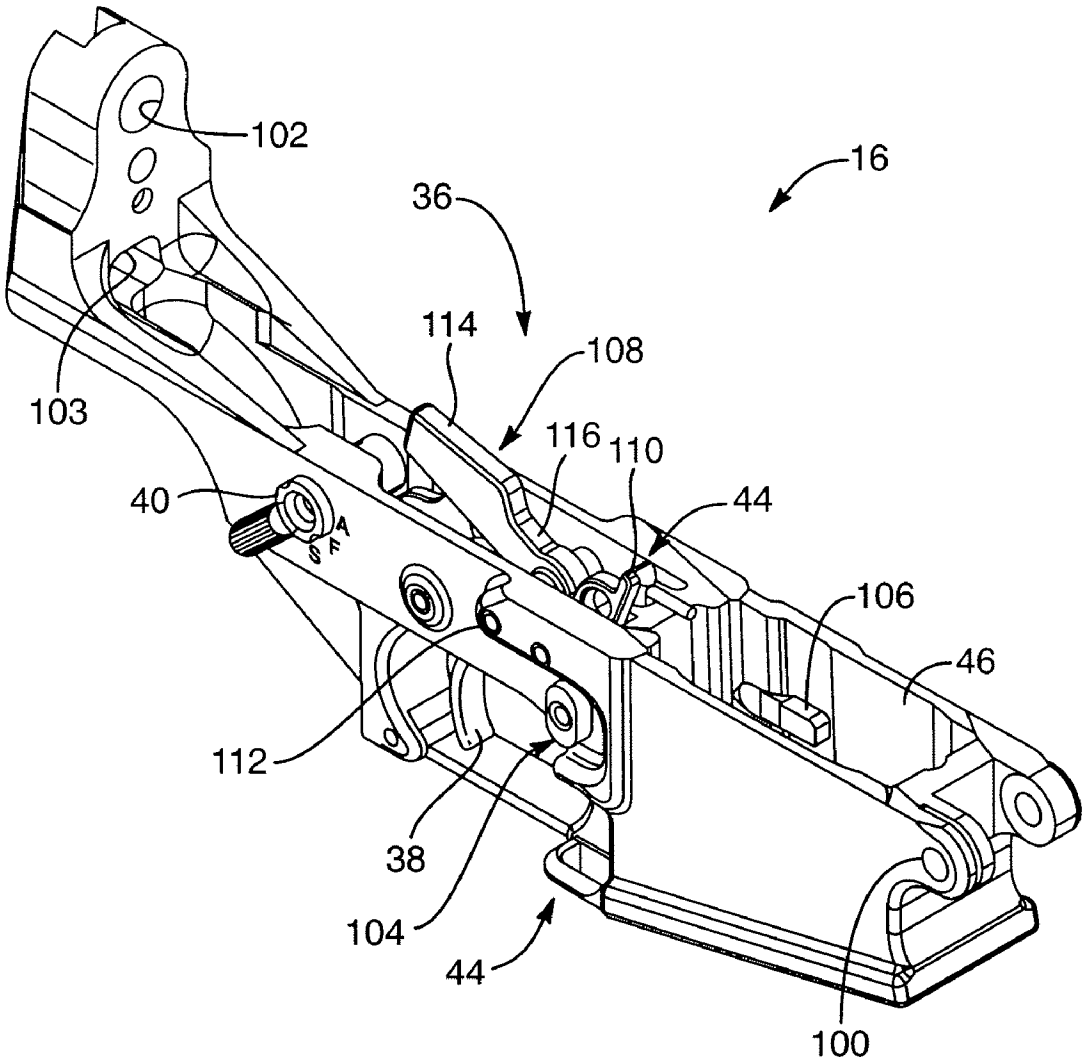
FIG. 5 is a perspective view of the lower receiver containing components of the fire control group.

Referring to FIG. 5, a perspective view illustrates the lower receiver 16 containing components of the fire control group 36. The lower receiver 16 includes a pivot hole 100 that allows the lower receiver 16 to pivot around the receiver pin 50 (shown in FIG. 1). The lower receiver 16 also includes an attachment structure 102 for attaching the lower receiver 16 to the upper receiver 14 of FIG. 1. The lower receiver 16 includes a pocket 103 that will be described below in relation to FIG. 6. In this embodiment, the attachment structure 102 is a hole that engages a mating attachment structure (shown in FIG. 13) that is connected to the upper receiver 14 of FIG. 1.

The lower receiver 16 is shown integrally formed with a magazine well 46 for receiving a magazine (not shown). The magazine well 46 includes a magazine release 104 that operates a magazine catch 106 that retains the magazine (not shown) in the magazine well 46.

The lower receiver 16 may be made of plastic, metal, ceramic, or composite. Furthermore, the lower receiver 16 may be manufactured by injection molding, casting, machining, or any other manufacturing process known in the art.

The fire control group 36 includes a trigger 38, a selector/safety switch 40, and a bolt hold open device 44. The fire control group 36 also includes a hammer 108 and an auto sear 110. The hammer 108 is used to impart kinetic energy to a firing pin (shown in FIG. 6) when the trigger 38 is pulled or for fully automatic firing of the firearm 10 when the trigger 38 is pulled and the auto sear 110 is tripped.

As shown, the hammer 108 is in a set position that is ready to strike the firing pin (not shown). When the hammer 108 is released, the hammer 108 pivots about a pin 112 and a head 114 of the hammer 108 strikes an end of the firing pin (shown in FIG. 6). The hammer 108 also includes a neck 116 that increases the angular momentum of the head 116.

Figure 6:
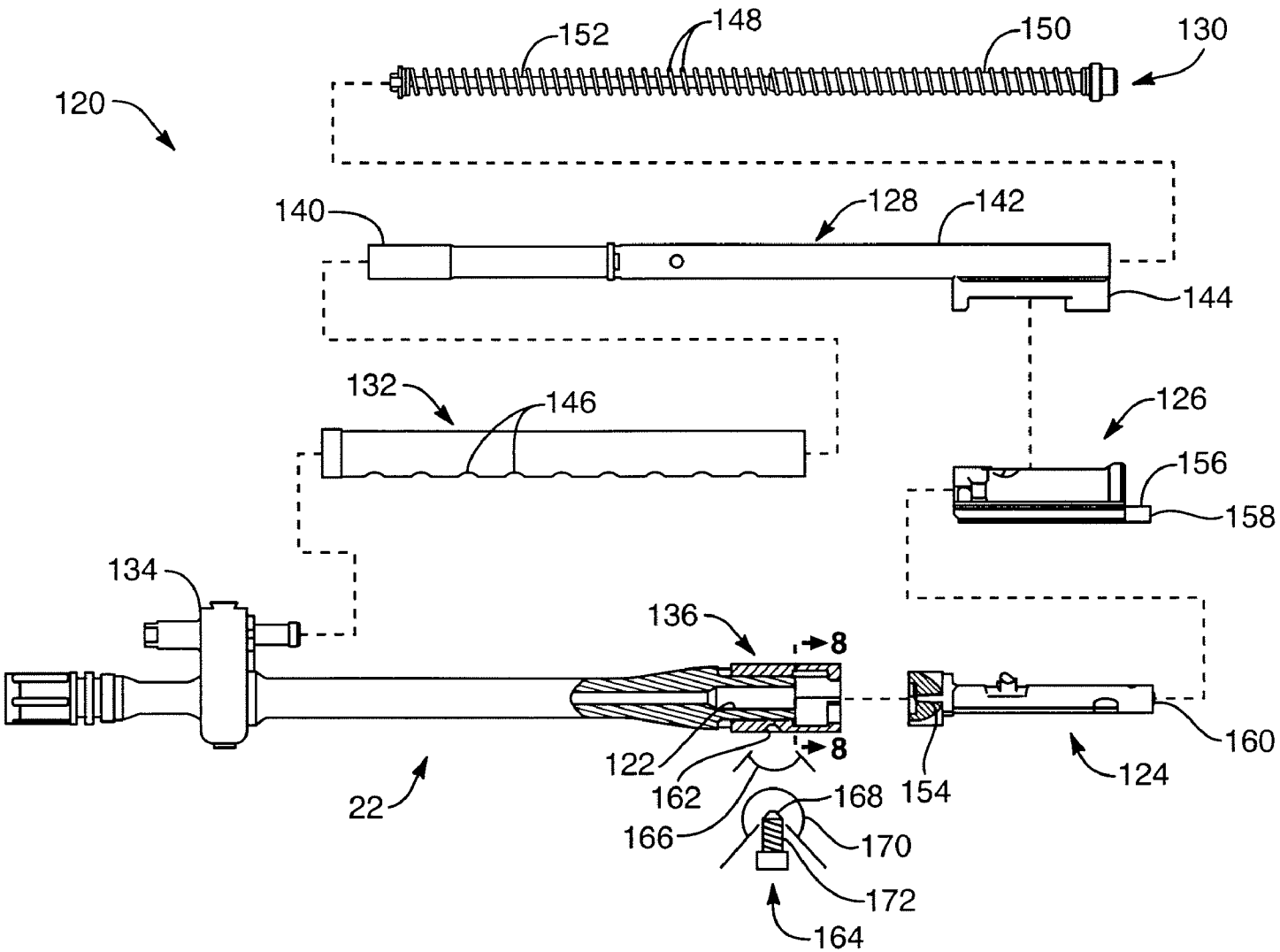
FIG. 6 is an exploded side elevation view of the operating system of the firearm.

Referring to FIG. 6 is an exploded side elevation view of the operating system 120 of the firearm 10 of FIG. 1. The operating system 120 includes the barrel 22 having a chamber 122, a bolt 124, a bolt carrier 126, an operating rod 128, a recoil spring assembly 130, a gas tube 132. The barrel 22 may include a gas block 134, and a barrel extension 136 and is shown attached to the gas block 134 and the barrel extension 136. The barrel 22 may be attached to the gas block 134 and the barrel extension 136 by welding, pinning, brazing, threading, and other methods known in the art.

When a cartridge (shown in FIG. 7) is disposed within the chamber 122 and fired, a propellant disposed within the cartridge is burned to produce gas and increase the pressure within the chamber 122. The high pressure gas then pushes a bullet (not shown) out of the barrel 22 toward a target. The high pressure gas flows through the barrel 22 from the chamber 122 toward the gas block 134. upon reaching the gas block 134, the high pressure gas exits the barrel 22 through a hole (not shown) in the barrel 22 and into the gas block 134.

The gas block 134 directs the gas into the gas tube 132. With reference to FIG. 2, the gas tube 132 is disposed within the second passageway 62 of the upper receiver 14. In some configurations, the second passageway 62 is the gas tube 132 and directly connected to the gas block 134.

The operating rod 128 includes a piston 140, a recoil tube 142, and a foot 144. The piston 140 is disposed within the gas tube 132 proximate the gas block 134. As the high pressure gas enters the gas tube, the high pressure gas pushes the piston 140 away from the gas block 134. The gas tube 132 includes vent holes 146 that help to prevent the high pressure gas from entering the operating rod cavity 72 of the upper receiver 14 (shown in FIG. 4). The high pressure gas is able then able to exit the firearm through the lightening cuts 84 (shown in FIG. 4) from the vent holes 146. Where the second passageway 62 is the gas tube 132, the gas vents directly through the lightening cuts 84 (shown in FIG. 4).

Preventing the high pressure gas from entering the operating rod cavity 72 of the upper receiver 14 (shown in FIG. 4) can be important because the high pressure gas deposits carbon, powder residue, and lead on the surfaces of the firearm 10 that the high pressure gas comes into contact with. These deposits can lead to firearm malfunctions, such as jamming, feeding problems, and ejection failures.

The recoil spring assembly 130 includes a spring 148 surrounding a guide rod 150 and a sliding rod 152. The recoil spring assembly 130 is connected to the operating rod 128 by being partially disposed within the recoil tube 142 of the operating rod 128. Alternatively, the recoil spring assembly 130 may be connected to the bolt carrier 126 or the bolt 124.

Thus, as the operating rod 128 moves away from the gas block 134 in reaction to the high pressure gas, the recoil spring assembly 130 is compressed and stores the kinetic energy of the moving operating rod 128 as potential energy in the spring 148 as the sliding rod 150 slides within the guide rod 150.

Additionally, the operating rod 128 is connected to the bolt carrier 126. The bolt carrier 126 carries the bolt 124 through the upper receiver 14 of FIG. 4 to lock or abut the bolt 124 against the chamber 122. Because the bolt carrier 126 is connected to the bolt 124, the bolt 124 moves as the bolt carrier 126 moves. Thus, as the operating rod 128 moves away from the gas block 134 in reaction to the high pressure gas, the bolt carrier 126 moves the bolt 124 to unlock from barrel extension 136 and from against the chamber 122.

As the bolt 124 moves away from the gas block 134, the bolt 124 removes the spent cartridge (shown in FIG. 7) from the chamber 122. As the bolt 124 moves away from the chamber 122, the bolt 124 moves past the ejector 94 of FIG. 4 so that the ejector 94 strikes the spent cartridge (shown in FIG. 7) to knock the spent cartridge from the bolt 124 and eject the spent cartridge through the ejection port 20 and out of the firearm 10 shown in FIG. 1. Additionally, the bolt 124 and bolt carrier 126 contact the head 114 of the hammer 108 (shown in FIG. 5) to place the hammer 108 in the set position as shown in FIG. 5.

Eventually, the operating rod 128, the bolt carrier 126, and the bolt 124 come to rest near an end of the upper receiver 14 of FIG. 4. Then, the recoil spring assembly 130 releases the potential energy stored in the spring 148 to push the operating rod 128, the bolt carrier 126, and the bolt 124 toward the gas block 134. As the bolt 124 moves toward the chamber 122, the bolt may be stopped by the bolt hold open device 44 (shown in FIG. 5) on the opposite side of the magazine well 46 (shown in FIG. 5) from the barrel 22, if an empty magazine (not shown) is held in the magazine well 46 (shown in FIG. 5). If a cartridge (shown in FIG. 7) is held in the magazine (not shown), the bolt 124 will push a cartridge out of the magazine and into the chamber 122. The firearm 10 of FIG. 1 is then ready to be fired.

The bolt 124 guides a firing pin 154 to properly strike a cartridge (shown in FIG. 7) causing it to fire. The bolt carrier 126 includes a safety extension 156. The safety extension 156 is disposed beneath the firing pin 154, so that the safety extension 156 is positioned between the firing pin 154 and the hammer 108 (shown in FIG. 5). When the bolt carrier 126 is furthest from the gas block 134, the safety extension extends within the pocket 103 of FIG. 5. The pocket 103 in conjunction with the safety extension 156 provides an additional measure of travel for the bolt carrier 124 within the upper receiver 14.

Providing an additional measure of travel reduces the felt recoil of firing the firearm 10 by increasing the distance over which the recoil spring assembly 130 may absorb kinetic energy from the bolt 124, bolt carrier 126, and the operating rod 128.

As the bolt 124 nears the chamber 122 but before the bolt 124 is locked against the chamber 122, the safety extension 156 is positioned over the pin 112 (shown in FIG. 5), which prevents the hammer from pivoting far enough to strike the firing pin 154. Once the bolt is locked against the chamber 122, the end 158 of the safety extension 156 is positioned past the pin 112 (shown in FIG. 5), allowing the hammer 108 to pivot far enough so that the head 114 of the hammer 108 (shown in FIG. 5) is able to strike the butt 160 of the firing pin 154. The neck 116 of the hammer 108 (shown in FIG. 5) may abut the end 158 of the safety extension 156 to place the head 114 of the hammer (shown in FIG. 5) above the safety extension 156. Additionally, the bolt 124 does not extend near the end 158 of the safety extension 156 until the bolt 124 has rotated within the bolt carrier 156, because of the design of the bolt carrier 126.

The barrel 22 is attached to the upper receiver 14 of FIG. 1 by a beveled barrel retention recess 162 and a barrel attachment device 164. In configurations where the barrel 22 includes a barrel extension 136, the beveled barrel retention recess 162 may be disposed in the barrel extension 136 of the barrel 22. The beveled barrel retention recess 162 is beveled at an angle 166. The angle 166 may range from about 170 degrees to about 10 degrees. In some configurations, the angle 166 may range from about 120 degrees to about 40 degrees. Alternatively, the angle 166 may range from about 90 degrees to about 60 degrees.

The barrel attachment device 164 includes a tapered end 168. The angle 170 of the tapered end 168 is about the reciprocal angle of the angle 166 of the beveled barrel retention recess 162. For example, if the angle 166 of the beveled barrel retention recess 162 is about 80 degrees, the angle 170 of the tapered end 168 is about 280 degrees.

The barrel attachment device 164 may be connected to the upper receiver 14 of FIG. 4 via the barrel retention feature 86. The barrel attachment device 164 may also include a threaded section 172 so that the barrel attachment device 164 may be screwed into the barrel retention feature 86 by engaging the threads 88 of the barrel retention feature 86. Once the barrel attachment device 164 is connected to the upper receiver 14, the barrel 22 may be slid into the first passageway 60 of the upper receiver 14 shown in FIG. 4 with an end of the barrel 22 nearest to the chamber 122. Next, the beveled barrel retention recess 162 of the barrel 22 is generally aligned with the tapered end 168 of the barrel attachment device 164. Next, the tapered end 168 engages the beveled barrel retention recess 162 to attach the barrel 22 to the upper receiver 14.

The angle 166 of the beveled barrel retention recess 162 facilitates the attachment of the barrel 22 to the upper receiver 14 of FIG. 4 because the angled surfaces of the tapered end 168 and the beveled barrel retention recess 162 encourages the barrel 22 to be attached at the same location each time the barrel 22 is attached to the upper receiver 14. As the tapered end 168 engages the beveled barrel retention recess 162, the surfaces of the tapered end 168 and the beveled barrel retention recess 162 slide past each other until approximately 360 contact exists between the tapered end 168 and the beveled barrel retention recess 162. This attachment of the barrel 22 with increased repeatability at the same location of the receiver 14 of FIG. 4 minimizes variances in the "zero" of the firearm, as the barrel is removed and reattached. "Zero" refers to the ability of a sighting device mounted on the firearm to predict the location of impact of a bullet fired from the firearm.

Figure 7:
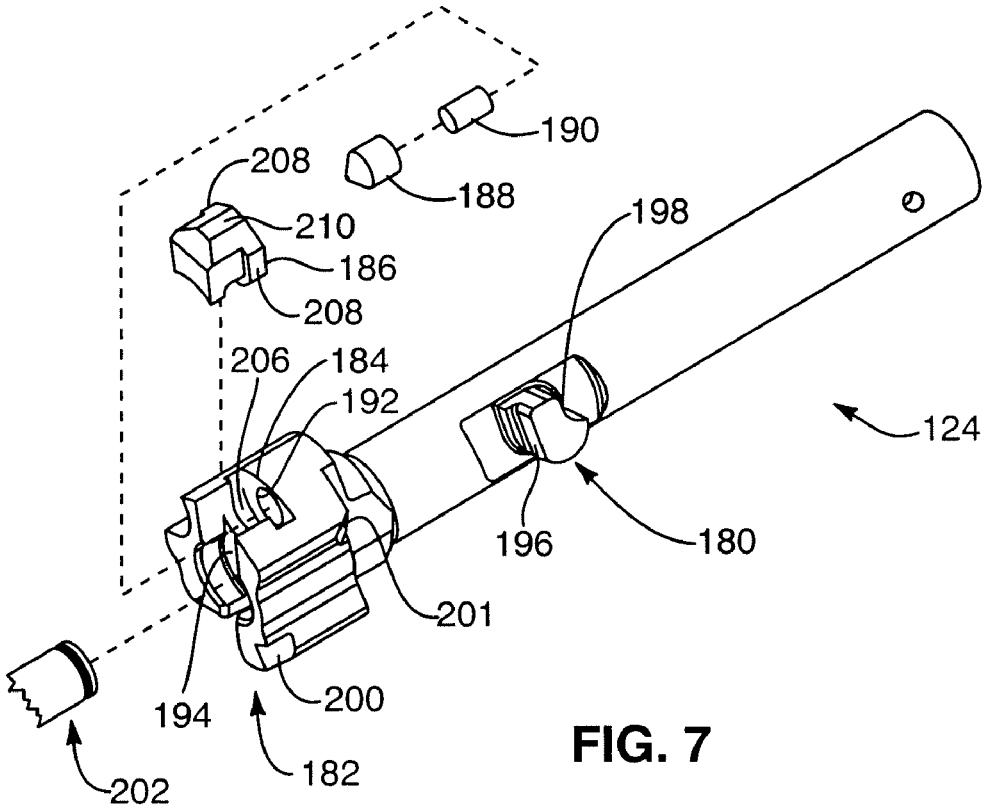
FIG. 7 is an exploded perspective view of a bolt of firearm.

Referring to FIG. 7, an exploded perspective view illustrates the bolt 124 of FIG. 6. As shown, the bolt 124 includes a protrusion 180 extending from the bolt 124, three lugs 182, an extractor slot 184, a sliding extractor 186, a detent 188, a polymer spring 190, a spring recess 192, and a bolt face 194. The protrusion 180 includes an extraction surface 196 and a cam surface 198. The protrusion interacts with the bolt carrier 126 of FIG. 7 to rotate the bolt to lock and unlock the bolt against the chamber 122 (shown in FIG. 7). The protrusion also interacts with the operating rod 128 of FIG. 7 to prevent the separation of the bolt 124 from the bolt carrier 126.

The lugs 182 are used to lock the bolt 124 within the barrel extension 136 (shown in FIG. 6). The lugs 182 also include a trip surface 200 that is used to initially cause the rotation of the bolt 124 into locking against the chamber 122 (shown in FIG. 6). A second trip surface 201 is used to initially cause the rotation of the bolt 124 into unlocking the bolt 124 from against the chamber 122. Because the first and second trip surfaces 200 and 201 are part of the lugs 182, the bolt head is circular and has regular diameter centered on the bolt face 194. This helps to evenly distribute the load forces among the lugs 182.

When the bolt 124 is assembled, the polymer spring 190 is seated within the spring recess 192 and the detent 188 extends from the spring recess 192 to retain the sliding extractor 186 within the extractor slot 184. The extractor 186 includes a surface (not shown) that mates with the detent 188 that allows the detent to convey the force of the polymer spring 190 to the extractor 186.

When the bolt engages a cartridge 202, the base 204 of the cartridge 202 abuts the bolt face 194, which moves the extractor 186 away from a bottom surface 206 of the extractor slot 184. The movement of the extractor 186 forces the detent 188 into the spring recess 192. The polymer spring 190 is compressed within the spring recess 192 and applies an opposite force on the detent 188 that biases the extractor 186 against the base 204 of the cartridge 202 to retain the base 204 of the cartridge 202 against the bolt face 194. Once the cartridge 202 is removed from the bolt face 194, the extractor 186 moves toward the bottom surface 206 of the extractor slot 184 reducing the forces exerted on and by the polymer spring 190.

The extractor 186 and the extractor slot 184 have a T-shape to better support the extractor 186 in order to avoid mechanical failure of the extractor. The wings 208 of the top of the T-shape provide solid sections of extractor 186 to support the forces of extracting the cartridge 202 from the chamber 122 (shown in FIG. 6) and supporting the higher forces during firing of the firearm 10. The use of the sliding extractor 186 with a polymer spring 190 that permits the extractor 186 to support forces where rotating extractors (not shown) typically fail, because of the introduced weakness from using a pivot pin (not shown). Weaknesses include a relatively large hole (not shown) extending through the extractor to accommodate the pivot pin (not shown), a large hole (not shown) extending through the lug used to accommodate the spring, and a thin lug structure (not shown) surrounding the rotating extractor (not shown).

The extractor 186 overcomes the weaknesses of a rotating extractor (not shown) by being stronger and smaller than a comparative rotating extractor (not shown). Additionally, the extractor 186 also includes an extractor head 210 that is supported by the barrel extension 136 shown in FIG. 6 to further prevent mechanical failure of the extractor 186.

The polymer spring 190 may be a solid piece of polymer such as polyethylene, polypropylene, polyurethane, rubber, isoprene rubber, polybutadiene, neoprene, or any other polymer known in the art. The polymer spring 190 is much smaller than an ordinary metal spring that may be used to support an extractor so that the hole in the lug 182 is much smaller than a hole for a metal spring. Therefore, the lug 182 supporting the extractor 186 is comparable to the other lugs 182 in strength.

Figure 8:
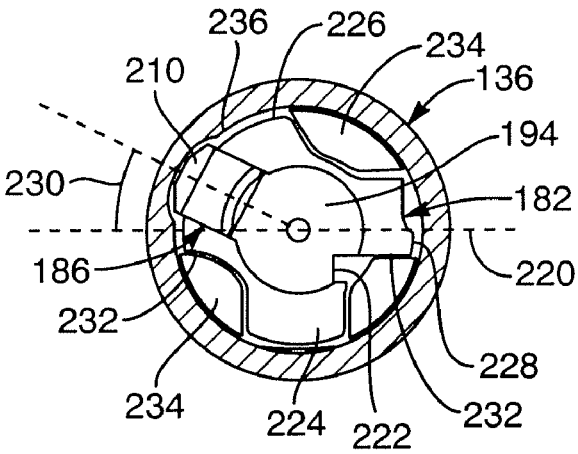
FIG. 8 is a cross section view along Section 8-8 of FIG. 6 of the bolt engaging a barrel extension of the firearm.

Referring to FIG. 8, a cross section view along Section 8-8 of FIG. 6 of the bolt 124 engaging the barrel extension 136 before the bolt 124 has begun rotating to lock against the chamber 122 shown in FIG. 6. As shown, the bolt 124 include a plane 220 extending through the middle of the bolt face 194 and perpendicular to the bolt face 194, an ejector access groove 222, and the lugs 182 include a feed lug 224, an extractor lug 226, and a third lug 228.

The ejector access groove permits the ejector 94 (shown in FIG. 4) to strike and eject a cartridge (shown in FIG. 7) from the firearm 10 that has been extracted from the chamber 122 (shown in FIG. 6). The feed lug 224 is the lug used to push a cartridge (not shown) out of a magazine (not shown) and into the chamber 122 (shown in FIG. 6). The extractor lug 226 supports the extractor 186. The third lug 228 provides an additional measure of support to the bolt 124 as it is locked within the barrel extension 136.

The extractor 186 may be disposed at an angle 230 of less than about forty-five degrees but greater than about ten degrees from the plane 220. In some configurations, the extractor 186 may be disposed at an angle 230 of about fifteen degrees to about thirty degrees. In other configurations, the extractor 186 may be disposed at an angle 230 of about twenty degrees to about twenty-five degrees.

The bolt 124 also includes guide surfaces 232 that are supported on the guidance feature 66 of the upper receiver 14 shown in FIG. 2. The guide surfaces 232 prevent the bolt 124 from rotating as the bolt 124 travels through the upper receiver 14 shown in FIG. 1.

The barrel extension 136 includes locking features 234 that abut the lugs 182 to lock the bolt 124 within the barrel extension 136. The barrel extension 136 also includes an extractor cam surface 236 that interacts with the bolt head 210 to support the extractor 186.

Figure 9:
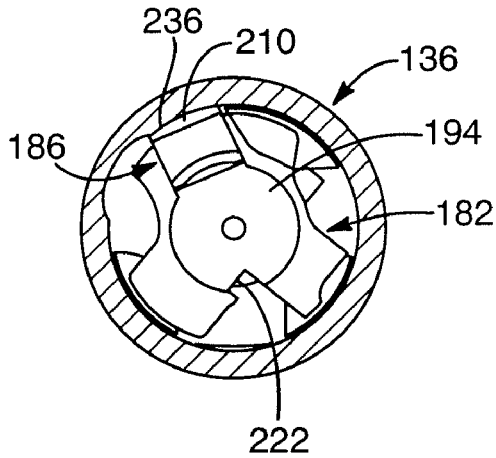
FIG. 9 is a cross section view along Section 8-8 of FIG. 6 of the bolt locked within the barrel extension.

Referring to FIG. 9, a cross section view along Section 8-8 illustrates FIG. 6 of the bolt 124 locked within the barrel extension 136. As shown, the bolt 124 has rotated counterclockwise to lock against the chamber 122 shown in FIG. 6 as viewed from the bolt 124 to the barrel 22. The locking features 234 abut the lugs 182 preventing the bolt 124 from separating from the barrel extension 136 and opening the chamber 122 (shown in FIG. 6). The extractor head 210 of the extractor 186 has engaged the extractor cam surface 236 to reinforce the extractor 186 in clamping down on a base of a cartridge (shown in FIG. 7). Using the barrel extension 136 to reinforce the extractor 186 helps to prevent damage to the bolt 124 and firearm 10 resulting from firing the firearm while there is blockage of the barrel 22 by reinforcing a normally weak part of the bolt 124.

Referring to FIG. 10, a perspective view illustrates the bolt carrier 126 of FIG. 6. The bolt carrier 126 includes an operating rod slot 240, a cam slot 242, a forward assist feature 244, and a charging handle feature 246. The operating rod slot 240 includes an opening 248 at an end of the bolt carrier 126 and a securing slot 250. The foot 144 of the operating rod 128 (shown in FIG. 6) engages the operating rod slot 240 to connect the operating rod 128 to the bolt carrier 126. The foot 144 of the operating rod 128 (shown in FIG. 6) extends into the opening 248 at an end of the bolt carrier 126 once the bolt 124 (shown in FIG. 7) is coupled to the bolt carrier 126 and the protrusion 180 of the bolt 124 (shown in FIG. 7) is disposed within the cam slot 242. The foot 144 prevents the bolt 124 (shown in FIG. 7) from being separated from the bolt carrier 126, while the operating rod 128 (shown in FIG. 6) is coupled with the bolt carrier 126. The foot 144 of the operating rod 128 (shown in FIG. 6) also extends into the securing slot 250.

The cam slot 242 includes a locking guide 252 and support surface 254. The locking guide 252 assists the bolt 124 (shown in FIG. 7) by converting the linear motion of the bolt carrier 126 to rotational motion of the bolt 124 as the bolt carrier 126 is moved to abut the barrel extension 136 (shown in FIG. 6). This occurs as the bolt 124 (shown in FIG. 7) is disposed within the barrel extension 136 and abuts the chamber 122 (shown in FIG. 6), the bolt carrier 126 continues to move toward the barrel extension 136 so that the protrusion 180 of the bolt 124 slides within the locking guide 252 of the cam slot 242.

As the bolt 124 of FIG. 7 is moved toward the chamber 122 (shown in FIG. 6), the support surface 254 engages the cam surface 198 of the protrusion 180 (shown in FIG. 6). The flat surface portions of the support surface 254 and the cam surface 198 of the protrusion 180 (shown in FIG. 6) allow the bolt carrier 126 to guide the bolt 124 through the upper receiver 14, without encouraging rotation of the bolt 124.

The forward assist feature 244 and the charging handle feature 246 allow a user to use a charging handle (shown in FIG. 14) to manually move the bolt carrier 126 toward the chamber 122 or away from the chamber 122 shown in FIG. 6 by abutting the forward assist feature 244 or the charging handle feature 246, respectively.

Figure 11:
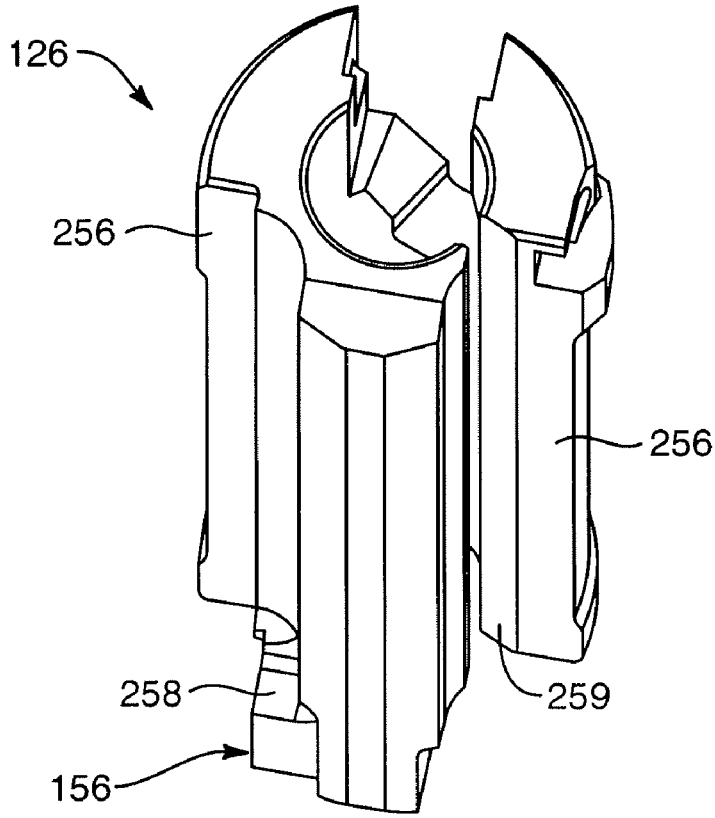
FIG. 11 is an alternative perspective view of a bolt carrier according to the invention.

Referring to FIG. 11, an alternative perspective view illustrates the bolt carrier 126. The bolt carrier 126 further includes carrier guide surfaces 256. The carrier guide surfaces 256 abut the guidance features 66 of the upper receiver 14 of FIG. 4. As shown, the safety extension 156 also includes an auto trip 258 that engages the auto sear 110 (shown in FIG. 5) to allow for automatic fire. The auto trip 258 is disposed proximate the bottom of the bolt carrier 126 and is a surface of the safety extension 156 that engages the auto sear 110 (shown in FIG. 5) as the bolt carrier 126 abuts the chamber 122 (shown in FIG. 6). By including the auto trip 258 as part of the safety extension 156, the auto sear 110 may be disposed adjacent the hammer 108 as shown in FIG. 5.

The bolt carrier 126 also includes an ejector slot 259. The ejector slot 259 provides the ejector 94 shown in FIG. 4 with the ability to extend into the bolt carrier 126 to eject a cartridge 202 (shown in FIG. 7) from the bolt face 194 via the ejector access groove 222 of the bolt 124 as shown in FIG. 8.

Figure 12:
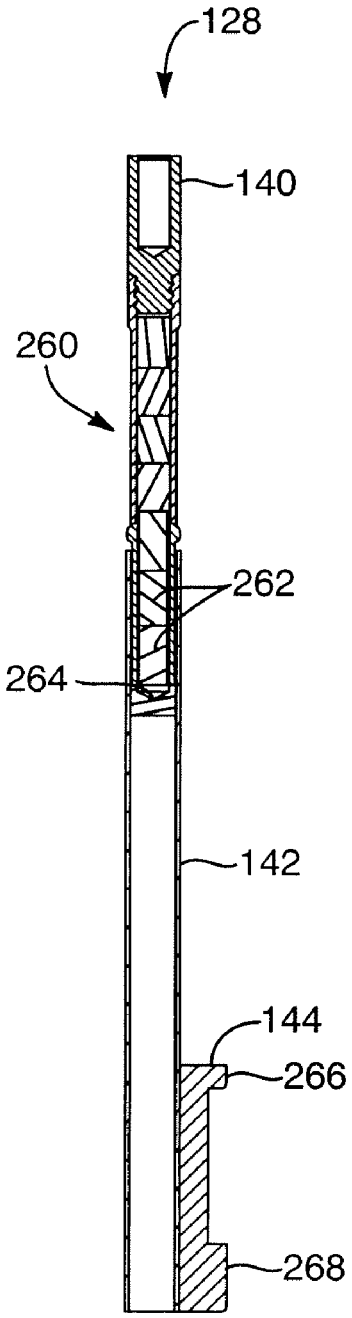
FIG. 12 is a cross section view of the operating rod of FIG. 6 that includes an anti-bounce mechanism.

Referring to FIG. 12, a cross section view illustrates the operating rod 128 of FIG. 6 as having an anti-bounce mechanism 260. The anti-bounce mechanism 260 includes a plurality of weights 262 that are disposed within a chamber 264 of the piston 140 of the operating rod. Of course, a single weight 262 may be used.

The anti-bounce mechanism 260 by allowing the weights 262 to come to rest after the operating rod 128, the bolt 124, and bolt carrier 126 (shown in FIG. 6) have been stopped by the barrel 22 (shown in FIG. 6). The abrupt stop of the operating rod 128, the bolt 124, and bolt carrier 126 (shown in FIG. 6) often results in reaction forces that may move the bolt 124 enough from the chamber 122 to cause a malfunction. The delayed impact of the weights 262 counters the reaction forces by transferring the momentum of the weights 262 to the operating rod 128, the bolt 124, and bolt carrier 126 (shown in FIG. 6). Therefore, the anti-bounce mechanism 260 helps to keep the bolt carrier 126 properly positioned against the chamber 122 (shown in FIG. 6) to prevent possible malfunctions that may result from bolt carrier bounce.

The foot 144 of the operating rod 128 includes a front post 266 and a rear post 268. The front post 266 is disposed within the opening 248 of the bolt carrier 126 (shown in FIG. 10). While the front post 266 is disposed within the opening 248 of the bolt carrier 126 (shown in FIG. 10), the front post 266 prevents the protrusion 180 of FIG. 7 from leaving the cam slot 242. The rear post 268 is disposed within the securing slot 250 of the bolt carrier 126 (shown in FIG. 10).

Figure 13:
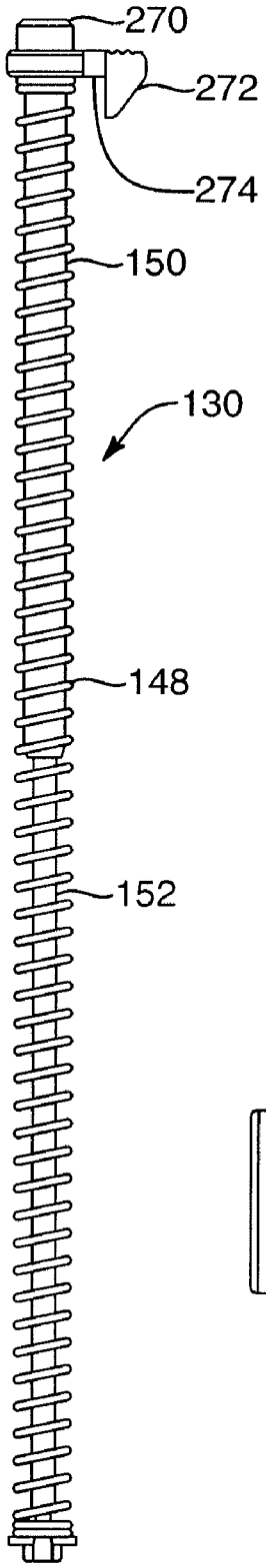
FIG. 13 is a side elevation view of a recoil spring assembly.

Referring to FIG. 13, a side elevation view illustrates the recoil spring assembly 130 of FIG. 6. As shown, the recoil spring assembly 130 includes a mating attachment structure 270 and a disassembly button 272. The mating attachment structure 270 engages with the attachment structure 102 of the lower receiver 16 (shown in FIG. 5) to attach the lower receiver 16 to the upper receiver 14 (shown in FIG. 1). The mating attachment structure 270 is a protrusion that extends from an end of the recoil spring assembly 130. Alternatively, where the attachment structure 102 of the lower receiver 16 is a protrusion rather than a hole, the mating attachment structure 270 may be a collar that fits around the protrusion.

Actuating the disassembly button 272 of the assembled firearm shown in FIG. 1 detaches the mating attachment structure 270 from the attachment structure 102 (shown in FIG. 5) to detach the lower receiver 16 from the upper receiver 14 of FIG. 1. The disassembly button 272 includes a neck 274 that extends into the disassembly button attachment point 74 as shown in FIGS. 3 and 4 so that the disassembly button 272 is disposed on the lateral 76 side of the upper receiver 14. The placement of the disassembly button 272 on the lateral 76 side of the upper receiver 14 allows the accessory rail at the 12 o'clock position 67 to extend the complete length of the upper receiver 14 as shown in FIG. 4.

Figure 14:
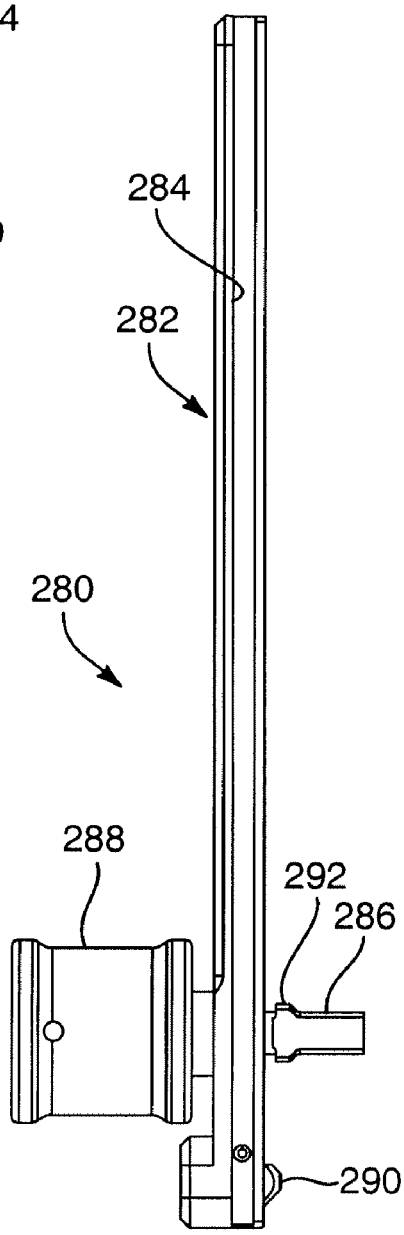
FIG. 14 is a side elevation view of a non-reciprocating charging handle with forward assist capability.

Referring to FIG. 14, a side elevation view illustrates a non-reciprocating charging handle 280 with forward assist capability. The charging handle 280 includes a body 282 having a groove 284 that engages the charging handle slot 71 (shown in FIG. 3). The charging handle 280 further includes an engagement pin 286, a handle 288, and a detent 290. The charging handle 280 is retained in position on the firearm until desired by a user via the detent 290. The engagement pin 286 extends into the upper receiver through the charging handle access groove 99.

The engagement pin 286 further includes a retaining ridge 292 that helps to prevent the engagement pin 286 from rotating in the upper receiver 14. The retaining ridge 292 is biased against the receiver 14 by a spring (not shown). In the biased position of the retaining ridge 292, the engagement pin 286 extends into the upper receiver far enough to abut the charging handle feature 246 of the bolt carrier 126 shown in FIG. 10. When a user chooses to selectively engage the forward assist feature 244 of the bolt carrier 126 shown in FIG. 10, the user pushes the handle 288 in the direction of the retaining ridge 292. Moving the handle 288 in the direction of the retaining ridge 292, moves the engagement pin 286 farther into the upper receiver 14 to engage the forward assist feature 244 of the bolt carrier 126 shown in (FIG. 10). Once the engagement pin 286 engages the forward assist feature 244 of the bolt carrier 126 (shown in FIG. 10), a user may move the handle and thus, the bolt 124 (shown in FIG. 7) to manually lock the bolt 124 against the chamber 122 (shown in FIG. 6). This design of the charging handle 280 allows a user to selectively engage the forward assist feature 244 of the bolt carrier 126, through the positioning of only the handle 288.

A method may be used to change the caliber of the firearm 10, described above, using caliber conversion parts. For the firearm 10, the caliber conversion parts include a barrel designed for the desired cartridge in addition to barrel already attached to the firearm 10, which is known in the art, and a bolt designed for the desired cartridge in addition to bolt already connected to the firearm 10, which is also known in the art. For convenience, the caliber conversion parts are referred to in the method as a "second" barrel or a "second" bolt, even though the second barrel and second bolt are almost identical to the barrel 22 and bolt 124 shown in FIG. 6, except for the small changes of dimensions inherent with changes in cartridge type that are well known by those of skill in the art.

In some cases, only a second barrel is needed to change the caliber of the firearm 10. Whether a second barrel or a second bolt is needed to change the caliber of the firearm 10, depends on how similar the dimensions of the first cartridge type to the second cartridge type, which information is known to those skilled in the art.

Thus, where the bolt of the firearm may be used with the new caliber, the method includes the steps of removing the barrel from the upper receiver, attaching the second barrel to the upper receiver, detaching the ejection buffer from the upper receiver at a first location, and attaching the ejection buffer to the upper receiver at a second location. Where a second bolt and a second barrel are needed to change the caliber of the firearm 10, the method may include the further steps of removing the bolt, bolt carrier, and operating rod from the firearm, disconnecting the operating rod from the bolt carrier to allow removal of the bolt from the bolt carrier, removing the bolt from the bolt carrier, disposing the second bolt in the bolt carrier, connecting the operating rod to the bolt carrier to prevent removal of the second bolt from the bolt carrier, and disposing the second bolt, bolt carrier, and operating rod in the firearm.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A firearm comprising:

a barrel;

a receiver;

an operating rod;

a bolt carrier supported by the receiver, the bolt carrier comprising, a slot having an open end and configured to receive and engage a portion of the operating rod, a cam slot in communication with the slot; and a bolt supported by the bolt carrier, the bolt comprising a protrusion which is received within the cam slot to slidably connect the bolt to the bolt carrier, wherein engagement of the portion of the operating rod within the slot prevents removal of the protrusion of the bolt from the cam slot.

2. The firearm of claim 1 wherein the bolt carrier further comprises a securing slot configured to receive a portion of the operating rod.

3. The firearm of claim 1, wherein the bolt carrier comprises a forward assist feature and the barrel comprises a chamber, wherein the firearm further comprises a non-reciprocating charging handle configured to engage the bolt carrier, the charging handle comprising a forward assist device that selectively engages the forward assist feature to provide manual locking of the bolt against the chamber.

4. The firearm of claim 3, wherein the non-reciprocating charging handle is configured to engage a lateral side of the bolt carrier.

5. The firearm of claim 1 wherein the cam slot comprises a locking guide and a support surface, where the locking guide is configured to rotate the bolt as the bolt abuts a chamber, and the support surface is configured to engage the bolt protrusion and to guide the bolt through the receiver without rotating the bolt.

6. The firearm of claim 1 wherein the bolt carrier further comprises a safety extension which includes and auto trip configured to engage an auto sear and allow for automatic fire.

7. The firearm of claim 6 wherein the auto sear is disposed proximate to a hammer.

8. The firearm of claim 1, wherein the operating rod comprises a foot and the portion of the operating rod engaging the slot is the foot.

9. A firearm comprising:

a bolt carrier comprising, a slot having an open end disposed at an end of the bolt carrier, a cam slot in communication with the slot, an ejector slot, and at least one carrier guide surface;

an ejector;

a bolt comprising a bolt face and an ejector access groove; and a receiver comprising at least one guide surface, wherein the ejector is configured to eject a cartridge from the bolt face via the ejector access groove, and the at least one carrier guide surface is configured to engage the at least one guide surface.

10. The firearm of claim 9 wherein the bolt further comprises a protrusion extending from the bolt, wherein the protrusion is received by the cam slot to thereby engage the bolt with the bolt carrier.

11. The firearm of claim 10 further comprising an operating rod engaging the slot and preventing removal of the protrusion of the bolt from the cam slot.

12. The firearm of claim 9 further comprising an operating rod wherein a portion of the operating rod engages the slot to couple the operating rod to the bolt carrier.

13. The firearm of claim 12 wherein the operating rod comprises a foot and the foot is the portion of the operating rod engaging the slot.

14. The firearm of claim 9 further comprising an operating rod including a foot, wherein the foot is at least partially disposable within the cam slot to prevent the removal of the protrusion of the bolt from cam slot and to connect the operating rod to the bolt carrier.

15. The firearm of claim 9, wherein the firearm comprises a barrel comprising a chamber, and the bolt carrier further comprises a forward assist feature, wherein the firearm further comprises a non-reciprocating charging handle, the charging handle comprising a forward assist device that selectively engages the forward assist feature to provide manual locking of the bolt against the chamber.

16. The firearm of claim 9, wherein the bolt further comprises a bolt face, a polymer spring, and an extractor, wherein the polymer spring biases the extractor against a base of a cartridge to retain the cartridge against the bolt face.

17. A firearm comprising:

a barrel;

a receiver;

an operating rod including a foot;

a bolt carrier supported by the receiver, the bolt carrier comprising, a slot comprising, an operating rod slot having an open end and configured to receive and engage the foot of the operating rod, and a cam slot in communication with the operating rod slot; and a bolt supported by the bolt carrier, the bolt comprising a protrusion which is received within the cam slot to slidably connect the bolt to the bolt carrier, wherein engagement of the foot of the operating rod within the operating rod slot prevents removal of the protrusion of the bolt from the cam slot.

* * * * *